US007690437B2

(12) United States Patent
Guillot et al.

(10) Patent No.: US 7,690,437 B2
(45) Date of Patent: Apr. 6, 2010

(54) METHODS AND APPARATUS FOR WELL CONSTRUCTION

(75) Inventors: Dominique Guillot, Somerville, MA (US); Geoffrey Maitland, Cambridge (GB); Iain Cooper, Sugarland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/133,059

(22) Filed: Jun. 4, 2008

(65) Prior Publication Data

US 2009/0000793 A1 Jan. 1, 2009

Related U.S. Application Data

(63) Continuation of application No. PCT/EP2006/010952, filed on Nov. 15, 2006.

(30) Foreign Application Priority Data

Dec. 5, 2005 (EP) ..... 05292621

(51) Int. Cl.
*E21B 34/06* (2006.01)

(52) U.S. Cl. ..... 166/387; 166/179; 166/177.2

(58) Field of Classification Search ..... 166/387, 166/179, 187, 294, 295, 177.1, 177.2
See application file for complete search history.

(56) References Cited

U.S. PATENT DOCUMENTS 7,059,415 B2 * 6/2006 Bosma et al. ..... 166/313
7,143,832 B2 * 12/2006 Freyer ..... 166/387
7,422,071 B2 * 9/2008 Wilkie et al. ..... 166/387
2004/0194971 A1 10/2004 Thomson
2005/0199401 A1 * 9/2005 Patel et al. ..... 166/387

FOREIGN PATENT DOCUMENTS

WO 03106811 12/2003
WO 2005059304 6/2005

* cited by examiner

*Primary Examiner*—Kenneth Thompson
(74) *Attorney, Agent, or Firm*—David Cate; Robin Nava; Jeff Griffin

(57) ABSTRACT

A method of constructing a well comprising a borehole drilled through underground formations, comprises: positioning at least one device on the outside of the tubular string (e.g. a drill string or casing string), the device being operable to move between first and second configurations; positioning a tubular string in the borehole with the device positioned in the annular space between the tubular string and the borehole wall in its first configuration so as to interact with the tubular string and the borehole while allowing borehole fluid to flow along the annular space and around the device; and operating the device so as to move it from its first configuration to expand into its second configuration in which it substantially fills at least part of the annular space so as to inhibit flow of fluids along the borehole in the space. Apparatus comprises: a string of tubular members; at least one device positioned on the outside of the string, the device being operable to expand between: (i) a first configuration in which, when the tubular string is positioned in the borehole with the device located in the annular space between the tubular string and the borehole wall, interacts with the tubular string and the borehole while allowing borehole fluid to flow along the annular space and around the device; and (ii) a second configuration in which it substantially fills at least part of the annular space so as to prevent flow of fluids along the borehole in the space.

8 Claims, 3 Drawing Sheets

METHODS AND APPARATUS FOR WELL CONSTRUCTION

This application is a Continuation of the PCT Application PCT/EP2006/010952 filed Nov. 15, 2006, which claims the benefit of EP Patent Application No. 05292621.9 filed on Dec. 5, 2005.

TECHNICAL FIELD

This invention relates to methods and apparatus for zonal isolation in well construction that are particularly applicable to boreholes such as oil and gas wells, or the like. They provide techniques that can be used in addition to or as an alternative to conventional well completion techniques such as cementing.

BACKGROUND ART

Completion of boreholes by casing and cementing is well known. Following drilling of the borehole, a tubular casing, typically formed from steel tubes in an end to end string is placed in the borehole and cement is pumped through the casing and into the annulus formed between the casing and the borehole wall. Once set, the cemented casing provides physical support for the borehole and prevents fluid communication between the various formations of from the formations to the surface (zonal isolation). However, problems can occur if drilling mud remains in the borehole when the cement is placed, or microannuli form around the casing and/or borehole wall. The effect of these can be to provide fluid communication paths between the various formations or back to the surface and consequent loss of zonal isolation.

Sections of annulus can also be isolated by the use of packers. These are typically flexible bladders that can be inflated by pumping a fluid into them so that they expand and seal against the borehole wall. One common type of packer, the external casing packer (ECP) is inflated by pumping cement into the bladder where it is allowed to set and form the local seal.

Packers also suffer from problems. For example, they can fail to inflate or hold their inflation; they can be damaged during installation so that inflation is not possible; they are expensive and unreliable.

There are certain devices used in casing cementing operations that assist in trying to avoid the problems mentioned above. Centralizers for holding casing in place, are well known. A schematic view of a known centralizer is shown in FIG. 1 and comprises a pair of collar sections 2, 4 that are located around the casing (nor shown). The collars 2, 4 are connected by arms 6 that are bowed so as to extend away from the casing. In use, the bowed arms 6 bear on the borehole wall and hold the casing centrally in the borehole at this location. This helps ensure a regular annulus that can be filled with cement evenly to try to provide a good seal. Turbolizers are devices for attachment to casing that interact with fluid (cement) flowing in the annulus to provide uniform placement of cement while it is being placed. FIG. 2 shows a schematic view of a known tubolizer which, like the centralizer shown in FIG. 1 comprises a pair of collars 8, 10 connected by bowed arms 12. However, in this case, a number of shaped fins 14 are connected to the arms 12. In use, the turbolizer is placed on the casing and as cement is pumped through the annulus in a cementing operation, the fins modify the flow so as to assist in more uniform placement of the cement and avoid irregular flow.

The problems discussed above in relation to cementing for zonal isolation discussed above can occur even when using devices such as centralizers and turbolizers. It is therefore an object of the invention to provide methods an apparatus that can help avoid these problems.

DISCLOSURE OF THE INVENTION

This invention is based on the use of materials that can be made to expand, swell or otherwise change their shape so as to fill at least part of the wellbore around a drill string or casing string or the like.

A first aspect of the invention comprises method of constructing a well comprising a borehole drilled through underground formations, the method comprising: positioning at least one device on the outside of the tubular string (e.g. a drill string or casing string), the device being operable to move between first and second configurations; positioning a tubular string in the borehole with the device positioned in the annular space between the tubular string and the borehole wall in its first configuration so as to interact with the tubular string and the borehole while allowing borehole fluid to flow along the annular space and around the device; and operating the device so as to move it from its first configuration to expand into its second configuration in which it substantially fills at least part of the annular space so as to inhibit flow of fluids along the borehole in the space.

Multiple devices can be positioned at locations spaced along the tubular string.

Cement can be pumped into the annulus before operating the device to move to its second configuration. In this case, the device(s) and cement together form the seal between the tubular string and the borehole wall. Alternatively, the device can be operated while the annulus is substantially free of cement so as to provide the only seal in the region of the well.

Preferably, a trigger is applied to initiate expansion of the device between the first and second configurations. Expansion can be initiated, for example, by changing the temperature or electric or magnetic field near the device, or irradiating with microwave or ultrasonic radiation, or by providing a chemical initiator in the region of the device.

In one embodiment, a trigger device can be run in the tubing string to initiate expansion.

In another embodiment, the trigger is applied by means of the fluid in the annulus. Using this approach, expansion can be initiated, for example, by changing the pH or the concentration of an electrolyte in fluid e.g. cement) in the region of the device. Alternatively, expansion can be triggered by absorption of water from the fluid in the annulus by the device.

The flow inhibition provided by the device in its second configuration can be complete, so as the prevent flow along the borehole, or partial so as to provide a restricted flow in the region of the tool. In the second case, the second configuration may comprise expansion to a diameter less than that of the borehole and/or incomplete expansion in the circumferential direction.

A second aspect of the invention comprises apparatus for constructing a well comprising a borehole drilled through underground formations, the apparatus comprising: a string of tubular members; at least one device positioned on the outside of the string, the device being operable to expand between: (i) a first configuration in which, when the tubular string is positioned in the borehole with the device located in the annular space between the tubular string and the borehole wall, interacts with the tubular string and the borehole while allowing borehole fluid to flow along the annular space and around the device; and (ii) a second configuration in which it substantially fills at least part of the annular space so as to prevent flow of fluids along the borehole in the space.

The device preferably comprises first members which, when the tubular string is located in the borehole and the device is in its first configuration, extend between the tubular string and the borehole wall so as to maintain the position of the tubular string in the borehole.

The device may also comprise second members, either alone or in conjunction with the first members, which, when the tubular string is located in the borehole and the device is in its first configuration, interact with fluid flowing in the annular space so as to modify its flow in the region of the device.

The device can be at least partially formed from a shape memory alloy, a swellable or expandable polymer, an electroactive cross-linked polymer, and/or a solid foam, or the like.

In other aspects of the invention, the device is arranged such that, in its first configuration, it has substantially no interaction with the borehole. In this case, a number of devices can be arranges as rings around the tubular string which are activated to provide the sealing effect. It is particularly preferred that the devices should comprise accelerated swellable materials.

MODE(S) FOR CARRYING OUT THE INVENTION

This invention finds particular application in well construction and can be applied in the drilling phase, or post-drilling cementing and casing phase of construction. While the invention is described below in relation to casing and cementing operations, similar operations can be applied to drilling activities such as casing drilling.

Figure 1:
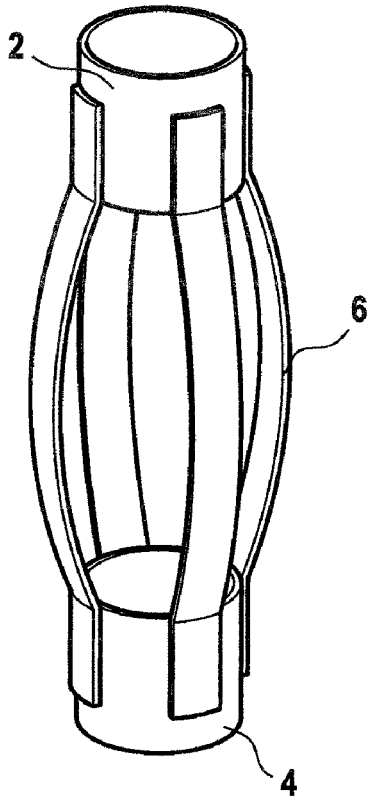
FIG. 1 shows a schematic view of a known centralizer.
Figure 2:
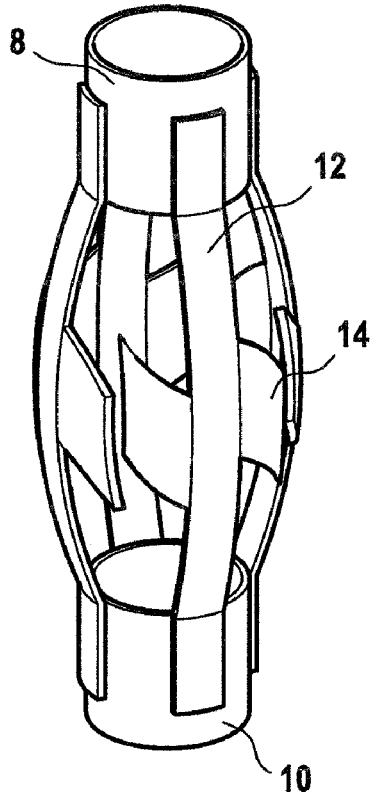
FIG. 2 shows a schematic view of a known turbolizer.

One embodiment of this invention provide devices such as turbolizers and centralizers that can be placed on casing to induce fluid mixing and to keep the casing central, but made, at least in part, from swellable materials. The general use, structure and function of centralizers and turbolizers is discussed above in relation to FIGS. 1 and 2. By providing such a device that incorporates expandable or swellable materials, two functions can be achieved: the casing/borehole interaction of the centralizer or turbolizer; and the sealing/zonal isolation function of the swellable structure. FIGS. 3-7 shows schematically embodiments of the invention comprising device such as centralizers or turbolizers (parts are omitted for clarity).

Figure 3:
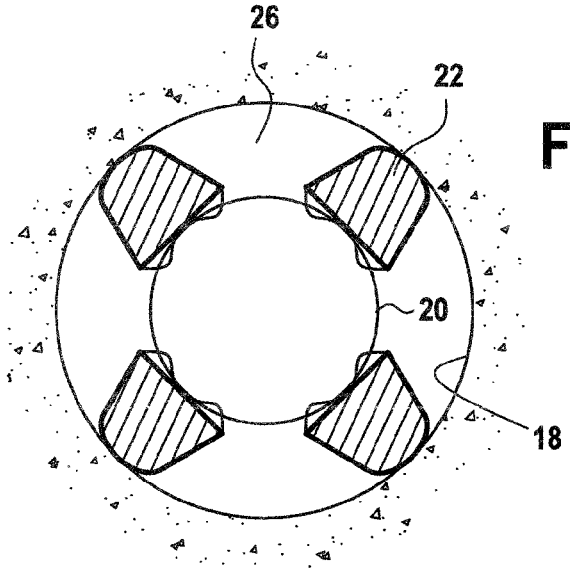
FIG. 3 shows a schematic plan view of a centralizer in accordance with an embodiment of the invention in a first configuration.
Figure 4:
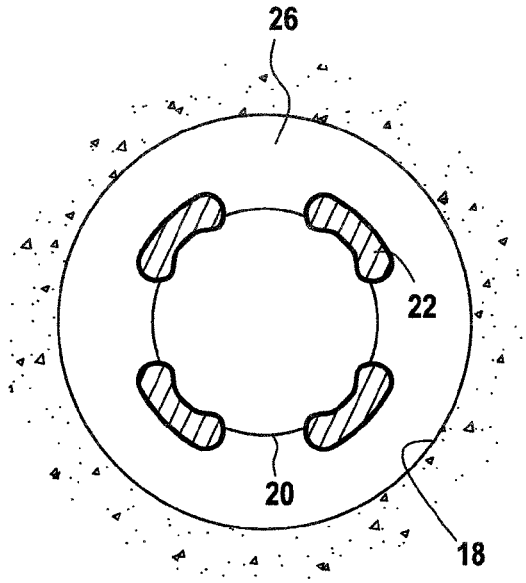
FIG. 4 shows a schematic plan view of a turbolizer in accordance with an embodiment of the invention in a first configuration.

In the embodiment of FIGS. 3 and 4, the borehole 18 has been drilled in a conventional manner and the casing 20, carrying centralizers (FIG. 3) or turbolizers 22 (FIG. 4 and 5) according to embodiments of the invention spaced at various locations along the casing 20. The locations for the devices preferably chosen both to provide a suitable interaction between the casing and the borehole, and to be adjacent a formation that allows a good seal to be formed for zonal isolation.

Figure 5:
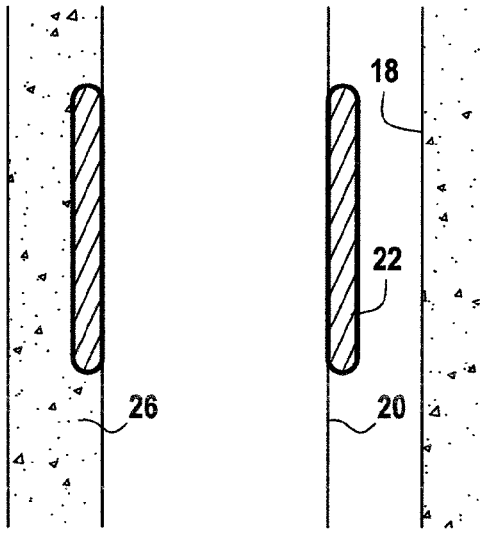
FIG. 5 shows a side view of the tubolizer of FIG. 4 in a first configuration.
Figure 6:
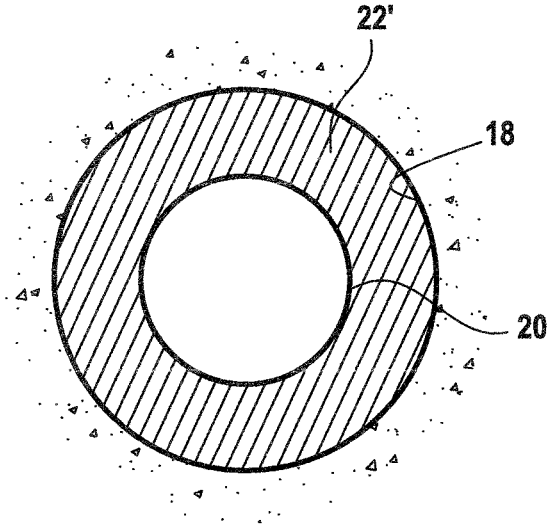
FIG. 6 shows a plan view of the centralizer of FIG. 3 or tubolizer of FIG. 4 in a second configuration.
Figure 7:
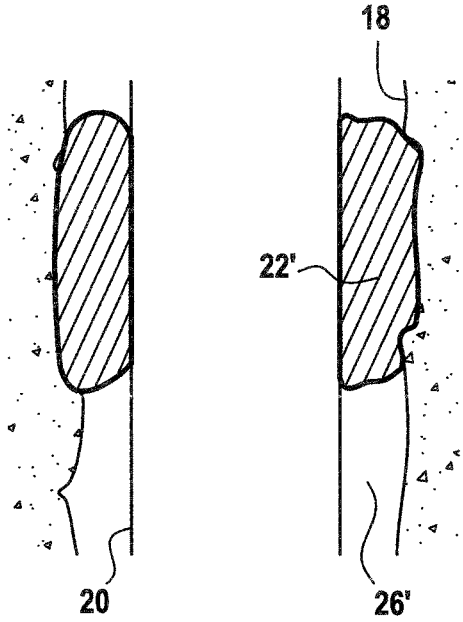
FIG. 7 shows a side view of the centralizer of FIG. 3 or tubolizer of FIG. 4 in a second configuration.

During placement of the casing 20 in the borehole, the devices 22 are in a first configuration of such a diameter so as to slide easily into the newly-drilled borehole 24 (see FIGS. 3, 4 and 5). When the casing 20 is in position, the conventional mud displacement/cement placement operation follows, the devices in the first configuration functioning as centralizers or turbolizers. In this configuration, fluids in the annulus can flow over or around the devices and along the borehole in the usual manner.

Once the cement 26 is in place but has not set, the devices 22 are triggered to expand into a second configuration to fill the whole annular space 22' between the casing and to seal against the adjacent rock (see FIGS. 6 and 7) in that region of the borehole, so giving enhanced local zonal isolation in addition to that provided by the cement sheath 26'. This means that deficiencies in the continuity of the cement annulus due to poor mud displacement, microannulus formation or subsequent cement cracking do not cause a critical loss of zonal isolation, the expanded device 22' acting as a barrier to flow along the annulus.

The materials used to make the devices to allow expansion include: shape memory alloys; swellable polymers (hydrogels), particularly polyelectrolyte cross-linked gels; electroactive cross-linked polymers/rubbers. Other materials can be used, for example ferrofluids sealed within and expandable bag, or the like. The particular material and manner in which it is provided can be selected according to requirements.

There are methods of triggering expansion in such materials. These are matched to the responsive material from which the devices are constructed.

Shape memory alloys (SMAs) can be activated thermally either by the ambient downhole temperature in the borehole, or by the temperature of the cement slurry, if the SMA expansion is relatively slow compared to the timescale of cement placement, or by the local exothermic heat of cement hydration during setting. Alternatively, for an SMA is with an activation temperature in excess of that reached during cementing, the expansion can be activated by hot water or drilling mud circulated down the centre of the casing to raise the temperature of the device.

Swellable polymers (hydrogels) are activated by uptake of water from the spacer and/or the cement, provided the time for complete annulus sealing is long compared with the initial period of cement placement, but smaller than cement set times. Polyelectrolyte cross-linked gels that swell in response to the high salinity and/or pH of cement slurry would be particularly favoured.

Electroactive cross-linked polymers/rubbers can be activated by a tool passed down the centre of the casing which provides a sufficient field gradient within the annulus over the limited range of the device to cause significant expansion. The device expands in the annulus against the rock surface to produce a seal in compression whilst the cement is still liquid. The activating tool remains in place until the cement has set around the expanded device to give a permanent seal.

Figure 8:
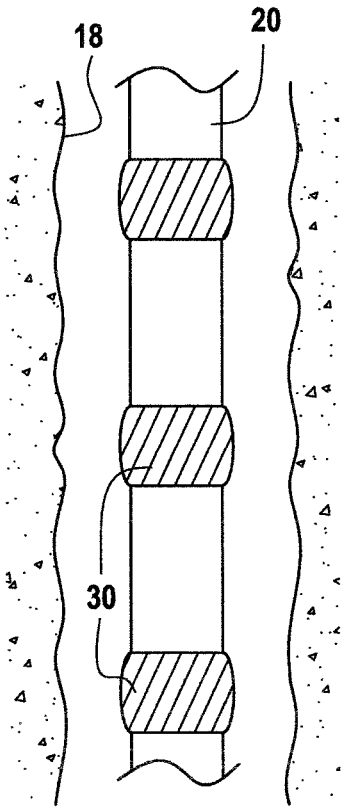
FIG. 8 shows a schematic side view of a further embodiment of the invention in a first configuration.
Figure 9:
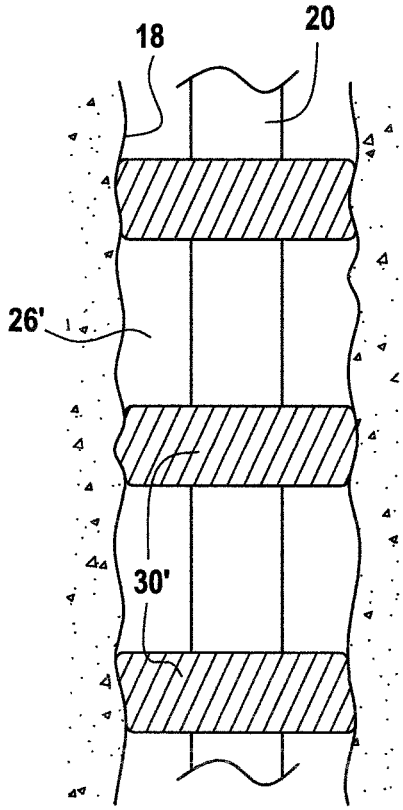
FIG. 9 shows a schematic side view of a further embodiment of the invention in a second configuration.

A further embodiment of the invention, that can be used in addition to that described above or as an alternative, is the use of new materials which give very rapid, high expansion in response to an appropriate stimulus. Such materials are known as accelerated swelling materials (ASMs). In accordance with this further aspect of the invention (see FIG. 8), rings of ASM 30 are placed at intervals on the outside of the casing 20 before placement, such that they only occupy a part of the annular space and enable the casing to be run into the borehole 18 with ease. Cement is placed in the annulus and before it sets, the ASMs rings 30 are expanded to form tight zonal isolation seals between the casing 20 and the formation, which are held in compression by the set cement 26'. Alternatively, no cement is placed and the ASM seal is activated by the drilling mud or a subsequent spacer fluid.

To achieve the rapid expansion, a swelling agent is provided in a way that allows rapid access to the swellable substrate throughout most of its bulk (as opposed to the relatively slow liquid diffusion process of conventional swellable materials).

In one suitable type of ASMs, the swelling rate is enhanced by increasing the swellable solid surface area/volume ratio and decreasing the solid path length through which solvent must diffuse by creation of a solid foam. The ASM thus swells very much like a sponge, with the solid matrix expanding though liquid uptake to increase the total seal volume and also reduce the ASM porosity. When activated by cement (salinity or pH trigger), for example, any remaining pore space is filled with set cement. Similarly a water-based or oil-based polymer spacer can act as activator, with release of encapsulated cross-linker for the polymer enabling the residual porosity of the expanded ASM to be filled with resin. Composite materials composed of a solvent (eg xylene) swellable elastomer matrix with a hard solid or high melting(Tg) dispersed phase are considered as particularly suitable for this approach.

The diffusion of heat is much more rapid than for mass, so a second type of ASMs is activated by a rapid expansion on change of temperature (in a similar way to the expansion of popcorn when heated). Shape memory alloys are one bulk material that will respond in this way. Composites comprising a matrix polymer below its glass transition temperature during placement with a solid or liquid dispersed phase which on heating converts to a gaseous dispersed phase (e.g. by volatilisation or chemical decomposition of the solid) within a softer matrix polymer (above its Tg after thermal activation) are another option.

The diffusion of gas into a solid matrix is much faster than for liquids. The third type of materials for ASMs are those which swell on exposure to an activating gas. This can occur because the gas causes a significant pH change within a pH responsive polymer (eg $CO_2$, $NH_3$) or due to favourable solvency/plasticization effects (eg $CH_4$ into low polarity oil-swellable polymers or composites).

It will be appreciated that certain changes can be made while remaining within the scope of the invention. For example, while the embodiments of the invention described above refer to use with casing, similar methods and apparatus can be applied to drill string that is to be left in situ once the well is drilled, or to completion tubing run into the well once it has been cased.

Alternative forms of device might include a device where the gaps between the turbolizer/centralizer fins (or, in an alternative design with holes through a doughnut device, similar to a large hypodermic needle through a septum) are held open mechanically with a spoked or tube-like object which allows flow in the first configuration and is then removed either mechanically (by pulling or pushing) or chemically (by dissolving, e.g. a soluble stent), enabling the gaps or holes to close up.

In another alternative, the centralizers/turbolizers are placed in the desired position by injecting into the annulus a swellable material that sets rapidly, causing partial filling of the annular space initially in the first configuration before being triggered to expand into the second configuration.

The invention claimed is:

1. A method of constructing a well comprising a borehole drilled through underground formations, the method comprising:

positioning at least one device on the outside of the tubular string, the device being operable to move between first and second configurations;

positioning a tubular string in the borehole with the device positioned in the annular space between the tubular string and the borehole wall in its first configuration so as to interact with the tubular string and the borehole while allowing borehole fluid to flow along the annular space and around the device; and applying a trigger to initiate expansion of the device between the first and second configurations operating the device so as to move it from its first configuration to expand into its second configuration in which it substantially fills at least part of the annular space so as to inhibit flow of fluids along the borehole in the space wherein expansion is initiated by irradiating the device with microwave or ultrasonic radiation.

2. A method as claimed in claim 1, comprising positioning multiple devices at locations spaced along the tubular string.

3. A method as claimed in claim 1, further comprising pumping cement into the annulus before operating the device to move to its second configuration.

4. A method as claimed in claim 1, comprising operating the device to move to its second configuration while the annulus is substantially free of cement.

5. Apparatus for constructing a well comprising a borehole drilled through underground formations; the apparatus comprising:

a string of tubular members;

at least one device positioned on the outside of the string, the device being operable to expand, when irradiated with microwave or ultrasonic radiation between:

(i) a first configuration in which, when the tubular string is positioned in the borehole with the device located in the annular space between the tubular string and the borehole wall, interacts with the tubular string and the borehole while allowing borehole fluid to flow along the annular space and around the device; and (ii) a second configuration in which it substantially fills at least part of the annular space so as to inhibit flow of fluids along the borehole in the space wherein the device is at least partially formed from a swellable or expandable polymer or an electroactive cross-linked polymer or both.

6. Apparatus as claimed in claim 5, wherein the device comprises first members which, when the tubular string is located in the borehole and the device is in its first configuration, extend between the tubular string and the borehole wall so as to maintain the position of the tubular string in the borehole.

7. Apparatus as claimed in claim 5, wherein the device comprises second members which, when the tubular string is located in the borehole and the device is in its first configuration, interact with fluid flowing in the annular space so as to modify its flow in the region of the device.

8. Apparatus as claimed in claim 5, comprising rings of accelerated swellable material positioned at locations along the tubular string.

* * * * *